US005143239A

United States Patent [19]

Yang

[11] Patent Number: 5,143,239

[45] Date of Patent: Sep. 1, 1992

[54] QUICK RELEASING DEVICE FOR A TANK

[75] Inventor: Wen C. Yang, Taichung, Taiwan

[73] Assignee: Biastro International Co., Ltd., Taichung, Taiwan

[21] Appl. No.: 717,465

[22] Filed: Jun. 19, 1991

[51] Int. Cl.[5] ..... B65D 53/00

[52] U.S. Cl. ..... 220/254; 220/326; 220/352

[58] Field of Search ..... 220/254, 256, 315, 326, 220/327, 352

[56] References Cited

U.S. PATENT DOCUMENTS

| | | | |
|---|---|---|---|
| 1,420,391 | 6/1922 | Sweet | 220/326 |
| 1,813,157 | 7/1931 | Granger | 220/326 |
| 1,859,003 | 5/1932 | Ragan | 220/326 |
| 2,053,212 | 9/1936 | Wakefield | 220/326 |
| 3,072,286 | 1/1963 | Cusumano | 220/326 |
| 4,380,302 | 4/1983 | Broad | 220/254 |
| 4,813,569 | 3/1989 | Ruiz | 220/254 |
| 4,941,789 | 7/1990 | Sims | 220/327 |

FOREIGN PATENT DOCUMENTS

| | | | |
|---|---|---|---|
| 1221198 | 1/1960 | France | 220/254 |

*Primary Examiner*—Joseph Man-Fu Moy
*Attorney, Agent, or Firm*—Staas & Halsey

[57] ABSTRACT

A releasing device for a tank including a bolt engageable in an opening of a tank, the bolt having a head formed on one end and having a bore formed in the center, a plug engageable in the bore of the bolt for blocking the bore, a ring coupled to the plug, a spring and a ball received in the plug, the ball being biased by the spring to engage with the bolt when the plug is engaged within the bore of the bolt so that the plug can be retained in place, and the plug can be easily pulled out of the bolt by the ring.

4 Claims, 2 Drawing Sheets

QUICK RELEASING DEVICE FOR A TANK

BACKGROUND OF THE INVENTION

1. Field of the Invention

The present invention relates to a releasing device, and more particularly to a quick releasing device for a tank, especially for an oil tank.

2. Description of the Prior Art

Typical tanks, such as fuel tank or oil tank, has an opening formed in a bottom thereof for threadedly engagement with a screw or a bolt. When the bolt is released or removed, the fuel or oil contained within the tank can be discharged. However, an additional tool is required to unthread the bolt so that the oil can be discharged. This is very inconvenient.

The present invention has arisen to mitigate and/or obviate the afore-described disadvantages of the conventional oil tanks.

SUMMARY OF THE INVENTION

The primary objective of the present invention is to provide a quick releasing device for a tank, which can be easily removed without an additional tool.

In accordance with one aspect of the invention, there is provided a releasing device for a tank which includes a bolt threadedly engageable within an opening formed in a bottom portion of the tank, the bolt including a head formed on one end thereof and a bore longitudinally formed therein, a recess formed in the bolt, a plug engageable within the bore of the bolt for blocking the bore and having a ring coupled to one end thereof, a hole formed in the plug, a protrusion including a spring and a ball received in the hole of the plug, the ball being biased by the spring to engage with the recess of the bolt when the plug is engaged within the bore of the bolt so that the plug can be stably retained in place, and the plug can be easily pulled out and disengaged from the bolt by the ring.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
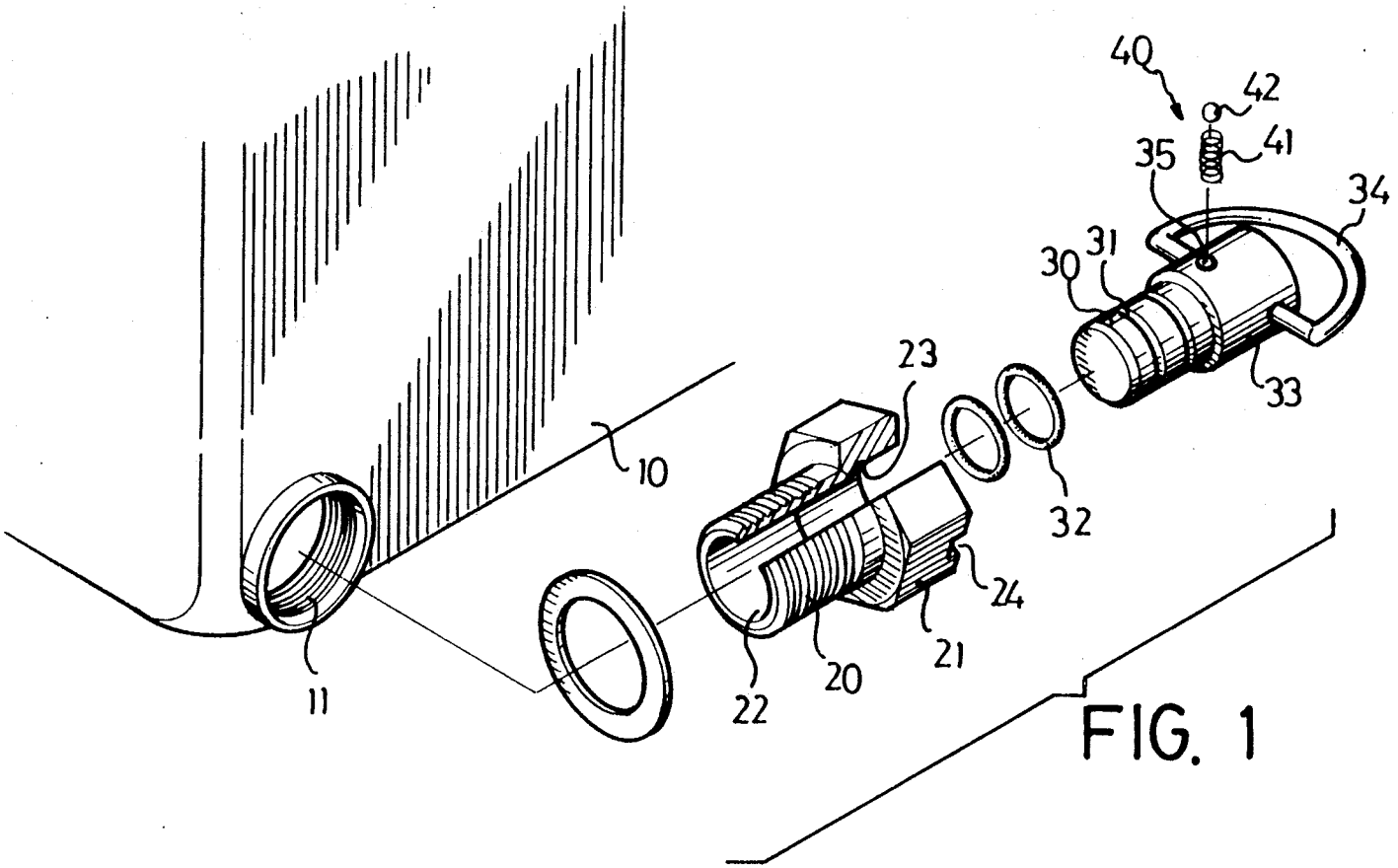
FIG. 1 is an exploded view of a quick releasing device in accordance with the present invention.
Figure 2:
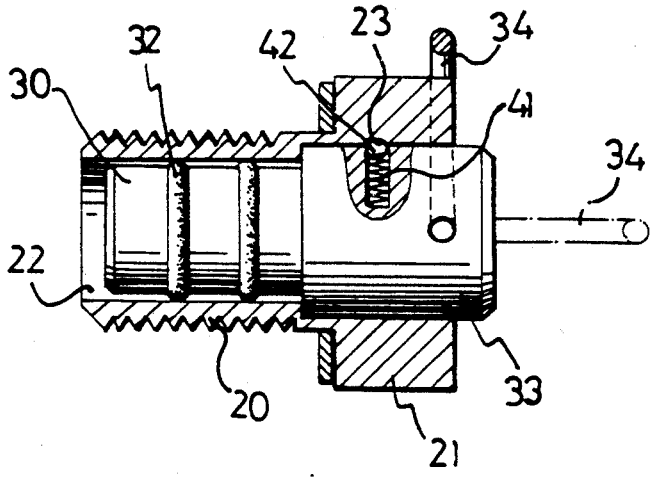
FIG. 2 is a cross sectional view of the quick releasing device.

Referring to the drawings and initially to FIGS. 1 and 2, a quick releasing device in accordance with the present invention is generally provided for plugging an opening 11 formed in a bottom of a tank 10, especially a fuel tank or an oil tank, and can be easily released so that the fuel or the oil contained within the tank 10 can be discharged.

The quick releasing device comprises generally a bolt 20 threadedly engageable within the opening 11 of the tank 10. The bolt 20 has a bolt head 21 formed in one end thereof so that the bolt 20 can be rotated and can be engaged into the opening 11 of the tank 10, and has a bore 22 longitudinally formed therein. A recess 23 is formed in the bolt 20. A slot 24 is formed in the outer surface of the bolt head 21 of the bolt 20.

Two annular grooves 31 are formed in a plug 30 and each has a sealing ring 32 received therein The plug 30 is engageable within the bore 22 of the bolt 20 so that the bore 22 can be blocked. A plug head 33 is formed on one end of the plug 30 and has a ring 34 coupled thereto. The root portion of the ring 34 can be engaged within the slot 24 of the bolt head 21. A hole 35 is formed in the plug head 33 of the plug 30. A protrusion 40 including a spring 41 and a ball 42 is engaged within the hole 35 of the plug head 33, in which the ball 42 can be slightly biased outward of the plug head 33 by the spring 41.

In operation, as shown in FIG. 2, when the plug 30 is engaged within the bore 22 of the bolt 20, the ball 42 of the protrusion 40 is biased to engage with the recess 23 formed in the bolt 20 so that the plug 30 can be retained in place. When the plug 30 is required to be removed, it is only required to pull the ring 34 outward of the bolt 20 so that the plug 30 can be easily removed and disengaged from the bolt 20 without any additional tool and so that the fuel or the oil contained within the tank can be discharged.

Figure 3:
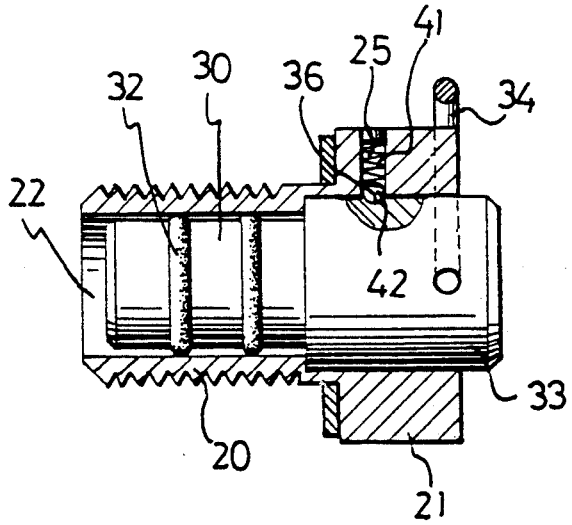
FIG. 3 is a cross sectional view illustrating another embodiment of the present invention.

Alternatively, as shown in FIG. 3, a recess 36 is formed in the plug head 33; and a hole 25 is formed in the bolt head 21 for receiving the protrusion 40. When the plug 30 is engaged within the bore 22 of the bolt 20, the ball 42 of the protrusion 40 is biased to engage with the recess 36 formed in the plug head 33 so that the plug 30 can be retained in place. When the plug 30 is required to be removed, it is only required to pull the ring 34 outward of the bolt 20 so that the plug 30 can be easily removed without any additional tool and so that the fuel or the oil contained within the tank can be discharged.

Accordingly, the quick releasing device in accordance with the present invention can be provided to plug the opening of the tank, and can be easily removed or released without additional tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A releasing device for a tank comprising a bolt threadedly engageable within an opening formed in a bottom portion of said tank, said bolt including a head formed on one end thereof and a bore longitudinally formed therein, a recess formed in said bolt; a plug engageable within said bore of said bolt for blocking said bore and having a ring coupled to one end thereof, a hole formed in said plug, a protrusion including a spring and a ball received in said hole of said plug; said ball being biased by said spring to engage with said recess of said bolt when said plug is engaged within said bore of said bolt so that said plug can be retained in place, and said plug can be pulled out of said bolt by said ring.

2. A releasing device according to claim 1, wherein said head of said bolt has a slot formed in an outer surface thereof, said ring has a root portion engageable within said slot of said head.

3. A releasing device according to claim 1, wherein said plug has at least one annular groove formed in an outer peripheral surface thereof, a sealing ring is engaged in each annular groove for making a water seal between said bolt and said plug.

4. A releasing device for a tank comprising a bolt threadedly engageable within an opening formed in a bottom portion of said tank, said bolt including a head formed on one end thereof and a bore longitudinally formed therein, a hole formed in said head of said bolt; a plug engageable within said bore of said bolt for blocking said bore and having a ring coupled to one end thereof, a recess formed in said plug, a protrusion including a spring and a ball received in said hole of said head of said bolt; said ball being biased by said spring to engage with said recess of said plug when said plug is engaged within said bore of said bolt so that said plug can be stably retained in place, and said plug can be pulled out of said bolt by said ring.

* * * * *